US009236173B2

(12) United States Patent
Yoo et al.

(10) Patent No.: US 9,236,173 B2
(45) Date of Patent: Jan. 12, 2016

(54) COIL PARTS AND METHOD OF MANUFACTURING THE SAME

(71) Applicant: Samsung Electro-Mechanics Co., Ltd., Gyeonggi-do (KR)

(72) Inventors: Young Seuck Yoo, Seoul (KR); Young Ghyu Ahn, Gyeonggi-do (KR); Yong Suk Kim, Gyeonggi-do (KR); Sang Moon Lee, Seoul (KR); Jeong Bok Kwak, Gyeonggi-do (KR); Kang Heon Hur, Gyeonggi-do (KR); Sung Kwon Wi, Seoul (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 13/707,526

(22) Filed: Dec. 6, 2012

(65) Prior Publication Data

US 2013/0147592 A1 Jun. 13, 2013

(30) Foreign Application Priority Data

Dec. 8, 2011 (KR) ..... 10-2011-0131055

(51) Int. Cl.
*H01F 5/00* (2006.01)
*H01F 27/28* (2006.01)
(Continued)

(52) U.S. Cl.
CPC ..... *H01F 5/003* (2013.01); *H01F 19/04* (2013.01); *H01F 41/041* (2013.01); *H01F 41/046* (2013.01); *H01F 2017/0066* (2013.01); *H01F 2017/0093* (2013.01); *Y10T 29/49075* (2015.01)

(58) Field of Classification Search
CPC ..... H01F 5/00; H01F 27/28
USPC ..... 336/200, 232
See application file for complete search history.

(56) References Cited

U.S. PATENT DOCUMENTS 5,420,558 A 5/1995 Ito et al.
5,572,179 A * 11/1996 Ito et al. ..... 336/200
(Continued)

FOREIGN PATENT DOCUMENTS

CN 102113116 A 6/2011
JP 54110424 A * 8/1979
(Continued)

OTHER PUBLICATIONS

JP 2012-260652 Office Action dated Apr. 1, 2014; 9pgs.
CN201210526111.7 Office Action dated Apr. 3, 2015; 15pgs.

*Primary Examiner* — Tsz Chan
(74) *Attorney, Agent, or Firm* — McDermott Will & Emery LLP

(57) ABSTRACT

The present invention discloses a coil part including: a lower magnetic body; primary and secondary lower patterns formed on the lower magnetic body in a spiral shape in parallel to each other; a lower insulating layer covering the primary and secondary lower patterns; primary and secondary upper patterns electrically connected to the primary and secondary lower patterns, respectively, and formed on the lower insulating layer in a spiral shape in parallel to each other to correspond to the primary and secondary lower patterns; and an upper magnetic body formed on the primary and secondary upper patterns, wherein the primary and secondary upper patterns have portions which cross the primary and secondary lower patterns on the plane, and a method of manufacturing the same.

9 Claims, 9 Drawing Sheets

(51) Int. Cl.

| | |
|---|---|
| ***H01F 41/04*** | (2006.01) |
| ***H01F 19/04*** | (2006.01) |
| *H01F 17/00* | (2006.01) |

(56) References Cited

U.S. PATENT DOCUMENTS

| | | | | |
|---|---|---|---|---|
| 2003/0151482 | A1* | 8/2003 | Mayfield | 336/180 |
| 2004/0130415 | A1* | 7/2004 | Chiba et al. | 333/185 |
| 2007/0285202 | A1* | 12/2007 | Ito et al. | 336/200 |
| 2010/0026368 | A1* | 2/2010 | Tang et al. | 327/361 |
| 2010/0157565 | A1* | 6/2010 | Yoshida et al. | 361/811 |

FOREIGN PATENT DOCUMENTS

| | | | |
|---|---|---|---|
| JP | 06-061072 | B2 | 3/1994 |
| JP | 06-120048 | A | 4/1994 |
| JP | 10-203066 | A | 8/1998 |
| JP | 2005-044952 | A | 2/2005 |
| JP | 2006-086460 | A | 3/2006 |
| JP | 2007-089133 | A | 4/2007 |
| JP | 2010-516056 | A | 5/2010 |
| JP | 2011-071457 | A | 4/2011 |
| KR | 10-2011-0050490 | A | 5/2011 |

* cited by examiner

- PRIOR ART -

- PRIOR ART -

- PRIOR ART -

- PRIOR ART -

COIL PARTS AND METHOD OF MANUFACTURING THE SAME

CROSS-REFERENCE TO RELATED APPLICATIONS

Claim and incorporate by reference domestic priority application and foreign priority application as follows:

CROSS REFERENCE TO RELATED APPLICATION

This application claims the benefit under 35 U.S.C. Section 119 of Korean Patent Application Serial No. 10-2011-0131055, entitled filed Dec. 8, 2011, which is hereby incorporated by reference in its entirety into this application."

BACKGROUND OF THE INVENTION

1. Field of the Invention

The present invention relates to coil parts and a method of manufacturing the same, and more particularly, to coil parts and a method of manufacturing the same that are capable of implementing high common-mode impedance in the same frequency, improving performance and capacity, and reducing manufacturing costs and improving productivity through simplification of structure and processes.

2. Description of the Related Art

Electronic products, such as digital TVs, smart phones, and notebook computers, have functions for data communication in radio-frequency bands. Such IT electronic products are expected to be more widely used since they have multifunctional and complex features by connecting not only one device but also USBs and other communication ports.

Here, for higher-speed data communication, data are communicated through more internal signal lines by moving from MHz frequency bands to GHz radio-frequency bands.

When more data are communicated between a main device and a peripheral device over a GHz radio-frequency band, it is difficult to provide smooth data processing due to a signal delay and other noises.

In order to solve the above problem, an EMI prevention part is provided around the connection between an IT device and a peripheral device. However, conventional EMI prevention parts are used only in limited regions such as specific portions and large-area substrates since they are coil-type and stack-type and have large chip part sizes and poor electrical characteristics. Therefore, there is a need for EMI prevention parts that are suitable for slim, miniaturized, complex, and multifunctional features of electronic products.

A common-mode filter of EMI prevention coil parts in accordance with the prior art is described below in detail with reference to FIG. 1.

Referring to FIGS. 1 to 2, a conventional common-mode filter includes a lower magnetic substrate 10, an insulating layer 20 disposed on the lower magnetic substrate 10 and including a first coil pattern 21 and a second coil pattern 22 which are vertically symmetrical to each other, and an upper magnetic body 30 disposed on the insulating layer 20.

Here, the insulating layer 20 including the first coil pattern 21 and the second coil pattern 22 is formed on the lower magnetic substrate 10 through a thin-film process. An example of the thin-film process is disclosed in Japanese Patent Application Laid-Open No. 8-203737.

And, a first input lead pattern 21*a* and a first output lead pattern 21*b* for inputting and outputting electricity to and from the first coil pattern 21 are formed on the insulating layer 20. A second input lead pattern 22*a* and a second output lead pattern 22*b* for inputting and outputting electricity to and from the second coil pattern 22 are formed on the insulating layer 20.

In more detail, the insulating layer 20 consists of a first coil layer including the first coil pattern 21 and the first input lead pattern 21*a*, a second coil layer including the second coil pattern 22 and the second input lead pattern 22*a*, and a third coil layer including the first output lead pattern 21*b* and the second output lead pattern 22*b*.

That is, the first coil layer is formed by coating an insulating material after forming the first coil pattern 21 and the first input lead pattern 21*a* on an upper surface of the lower magnetic substrate 10 through a thin-film process.

And, the second coil layer is formed by coating an insulating material after forming the second coil pattern 22 corresponding to the first coil pattern 21 and the second input lead pattern 22*a* on an upper surface of the first coil layer through a thin-film process.

Next, the third coil layer is formed by coating an insulating material after forming the first output lead pattern 21*b* and the second output lead pattern 22*b* on an upper surface of the second coil layer through a thin-film process for external output of the first coil pattern 21 and the second coil pattern 22.

At this time, the first coil pattern 21 and the second coil pattern 22 may be electrically connected to the first output lead pattern 21*b* and the second output lead pattern 22*b* through via connection structures, respectively.

Meanwhile, the first coil layer to the third coil layer may be formed in a sheet shape and combined in a stack-type to configure the above-described insulating layer including the first and second coil patterns, the first and second input lead patterns, and the first and second output lead patterns.

However, in the conventional common-mode filter configured as above, the insulating layer 20 is formed of at least three coil layers by forming the first coil pattern 21 and the second coil pattern 22 on the separate coil layers and forming the first and second output lead patterns 21*b* and 22*b* on the other coil layer, thus causing an increase in the vertical size of a product including it.

Especially, when increasing capacity in order to improve noise removal performance, since the second coil layer should be added simultaneously with adding the first coil layer, the vertical size of the product is more increased and the time and costs required for manufacturing processes are increased due to addition of the number of processes.

SUMMARY OF THE INVENTION

The present invention has been invented in order to overcome the above-described problems and it is, therefore, an object of the present invention to provide coil parts and a method of manufacturing the same that are capable of implementing high common-mode impedance in the same frequency.

It is another object of the present invention to provide coil parts and a method of manufacturing the same that are capable of minimizing an increase in the size of a product accompanied when increasing performance and capacity.

It is still another object of the present invention to provide coil parts and a method of manufacturing the same that are capable of reducing manufacturing costs and improving productivity through simplification of structure and processes.

In accordance with one aspect of the present invention to achieve the object, there is provided a coil part including: a lower magnetic body; primary and secondary lower patterns formed on the lower magnetic body in a spiral shape in parallel to each other; a lower insulating layer covering the primary and secondary lower patterns; primary and secondary upper patterns electrically connected to the primary and secondary lower patterns, respectively, and formed on the lower insulating layer in a spiral shape in parallel to each other to correspond to the primary and secondary lower patterns; and an upper magnetic body formed on the primary and secondary upper patterns, wherein the primary and secondary upper patterns have portions which cross the primary and secondary lower patterns on the plane.

The primary and secondary upper patterns may be arranged to cross arrangement of the primary and secondary lower patterns.

At this time, the primary and secondary upper patterns may be arranged to be positioned in a space between the primary and secondary lower patterns in the crossing portions.

The lower insulating layer may include a primary coating layer covering the primary and secondary lower patterns and a secondary coating layer for planarizing an upper surface of the primary coating layer.

Meanwhile, widths of the primary and secondary lower patterns may be formed larger than those of the primary and secondary upper patterns.

Here, widths of the innermost pattern and the outermost pattern of the primary and secondary lower patterns may be formed larger than that of the pattern positioned between the innermost pattern and the outermost pattern.

And, the primary and secondary upper patterns may be formed in a spiral shape extending from the primary and secondary lower patterns and having the same number of turns.

At this time, an output-side portion of the outermost pattern of the primary and secondary upper patterns may be formed to be positioned on the pattern adjacent to the inside of the outermost pattern of the primary and secondary lower patterns.

The coil part in accordance with the present invention may further include a resistance tuning portion expanding from a portion of the outermost pattern of the longer pattern of the primary and secondary lower patterns.

Meanwhile, the primary and secondary upper patterns and the primary and secondary lower patterns may be electrically connected through vias.

And, the upper magnetic body may be formed to extend to centers of the primary and secondary upper patterns and the primary and secondary lower patterns.

In accordance with another aspect of the present invention to achieve the object, there is provided a method of manufacturing a coil part including the steps of: preparing a lower magnetic body; forming primary and secondary lower patterns on the lower magnetic body in a spiral shape in parallel to each other; forming a lower insulating layer on the primary and secondary lower patterns; forming primary and secondary upper patterns on the lower insulating layer in a spiral shape in parallel to each other to correspond to the primary and secondary lower patterns, wherein the primary and secondary upper patterns are formed to have portions which cross the primary and secondary lower patterns on the plane; and forming an upper magnetic body on the primary and secondary upper patterns.

The primary and secondary upper patterns may be arranged to cross arrangement of the primary and secondary lower patterns.

At this time, the primary and secondary upper patterns may be arranged to be positioned in a space between the primary and secondary lower patterns in the crossing portions.

Meanwhile, the step of forming the lower insulating layer may include the steps of: forming a primary coating layer on the primary and secondary lower patterns; and forming a secondary coating layer on the primary coating layer.

Widths of the primary and secondary lower patterns may be formed larger than those of the primary and secondary upper patterns.

Here, widths of the innermost pattern and the outermost pattern of the primary and secondary lower patterns may be formed larger than that of the pattern positioned between the innermost pattern and the outermost pattern.

And, the primary and secondary upper patterns may be formed in a spiral shape extending from the primary and secondary lower patterns and having the same number of turns.

At this time, an output-side portion of the outermost pattern of the primary and secondary upper patterns may be formed to be positioned on the pattern adjacent to the inside of the outermost pattern of the primary and secondary lower patterns.

Meanwhile, the step of forming the primary and secondary lower patterns may further include the step of forming a resistance tuning portion by expanding a portion of the outermost pattern of the longer pattern of the primary and secondary lower patterns.

And, the step of forming the primary and secondary upper patterns may include the step of electrically connecting the primary and secondary upper patterns to the primary and secondary lower patterns through vias.

Further, the step of forming the upper magnetic body may include the step of extending the upper magnetic body to centers of the primary and secondary upper patterns and the primary and secondary lower patterns.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIGS. 8*a* to 8*c* are process diagrams schematically showing a process of forming the primary and secondary lower patterns and the primary and secondary upper patterns, wherein FIG. 8*a* is a view showing a state in which a primary coating layer is formed on the primary and secondary lower patterns, FIG. 8*b* is a view showing a state in which a secondary coating layer is formed on the primary coating layer of FIG. 8*a*, and FIG. 8*c* is a view showing a state in which the primary and secondary upper patterns are formed on the secondary coating layer of FIG. 8*b;*

DETAILED DESCRIPTION OF THE PREFERABLE EMBODIMENTS

Figure 1:
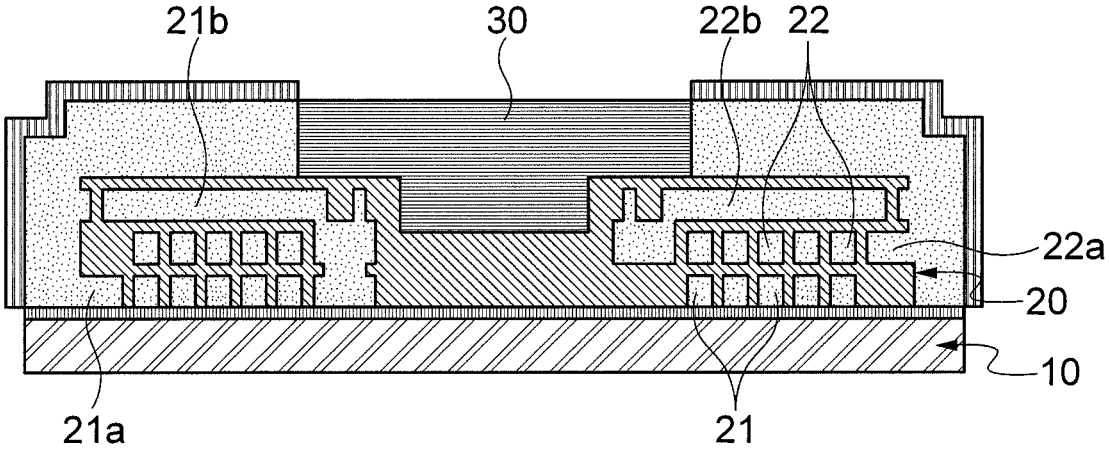
FIG. 1 is a cross-sectional view schematically showing a common-mode filter of coil parts in accordance with the prior art.
Figure 2A:
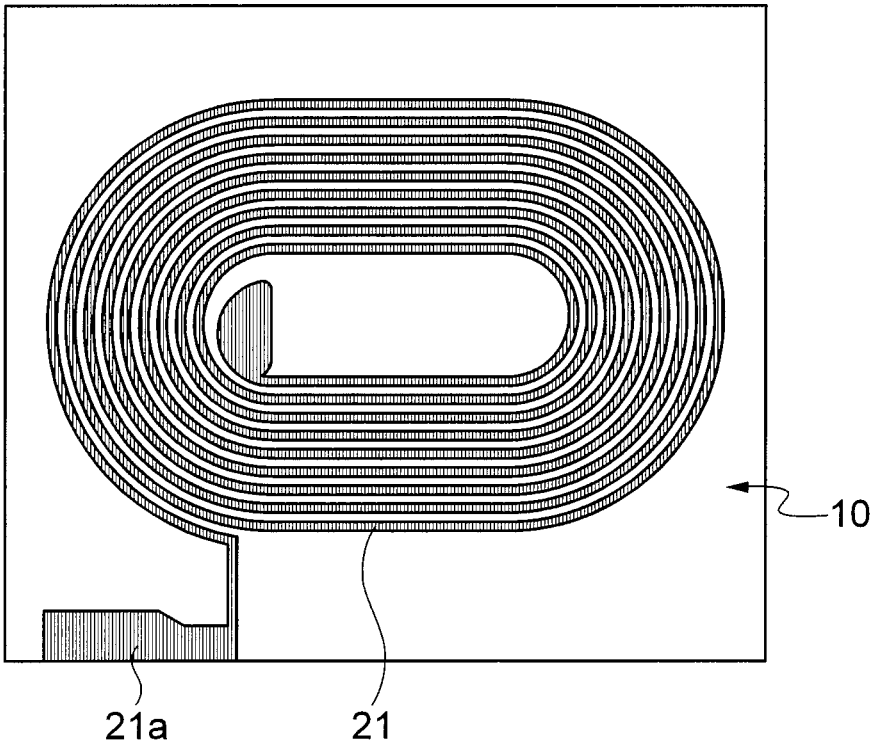
FIG. 2*a* is a plan view schematically showing a primary coil pattern of FIG. 1.
Figure 2B:
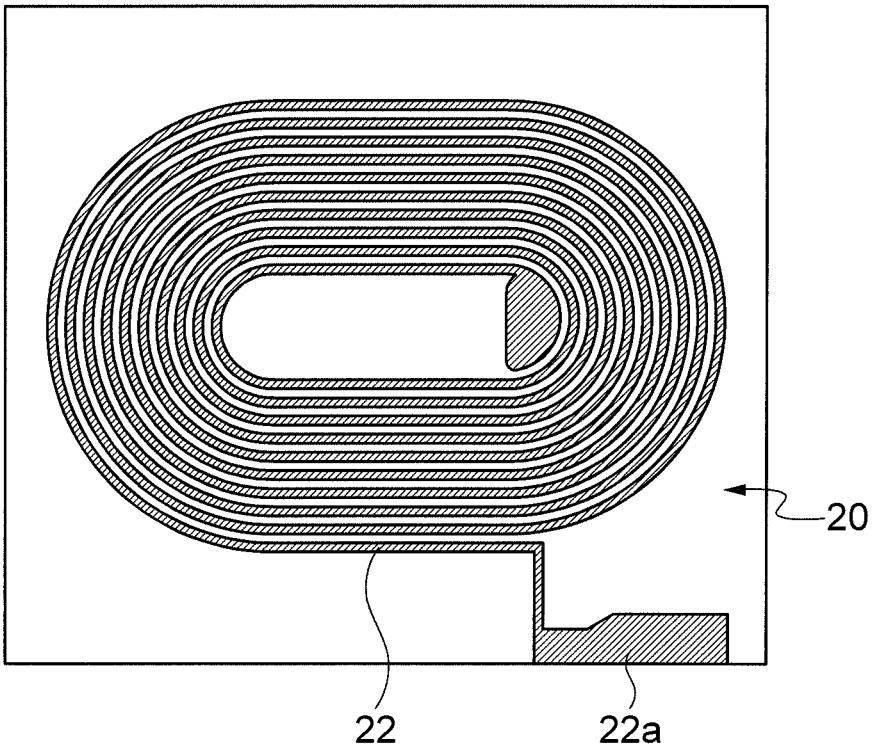
FIG. 2*b* is a plan view schematically showing a secondary coil pattern of FIG. 1.
Figure 2C:
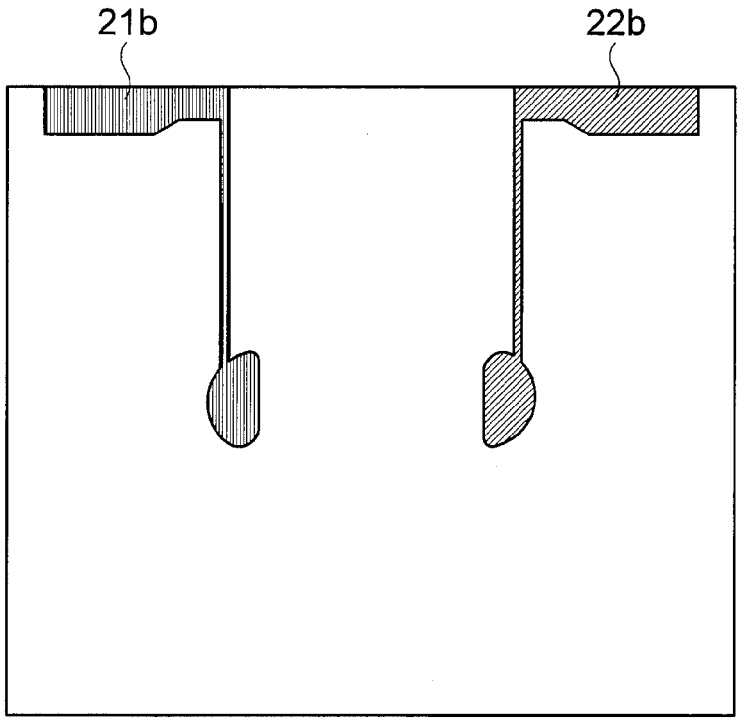
FIG. 2*c* is a plan view schematically showing output-side lead electrodes for output of the primary coil pattern and the secondary coil pattern of FIG. 1.

Advantages and features of the present invention and methods of accomplishing the same will be apparent by referring to embodiments described below in detail in connection with the accompanying drawings. However, the present invention is not limited to the embodiments disclosed below and may be implemented in various different forms. The exemplary embodiments are provided only for completing the disclosure of the present invention and for fully representing the scope of the present invention to those skilled in the art. Like reference numerals refer to like elements throughout the specification.

Terms used herein are provided to explain embodiments, not limiting the present invention. Throughout this specification, the singular form includes the plural form unless the context clearly indicates otherwise. When terms "comprises" and/or "comprising" used herein do not preclude existence and addition of another component, step, operation and/or device, in addition to the above-mentioned component, step, operation and/or device.

Further, embodiments to be described throughout the specification will be described with reference to cross-sectional views and/or plan views, which are ideal exemplary drawings of the present invention. In the drawings, the thicknesses of layers and regions may be exaggerated for the effective explanation of technical contents. Therefore, the exemplary drawings may be modified by manufacturing techniques and/or tolerances. Therefore, the embodiments of the present invention are not limited to the accompanying drawings, and can include modifications to be generated according to manufacturing processes. For example, an etched region shown at a right angle may be formed in the rounded shape or formed to have a predetermined curvature. Therefore, regions shown in the drawings have schematic characteristics. In addition, the shapes of the regions shown in the drawings exemplify specific shapes of regions in an element, and do not limit the invention.

Hereinafter, an embodiment of coil parts and a method of manufacturing the same in accordance with the present invention will be described in detail with reference to FIGS. 3 to 10.

Figure 3:
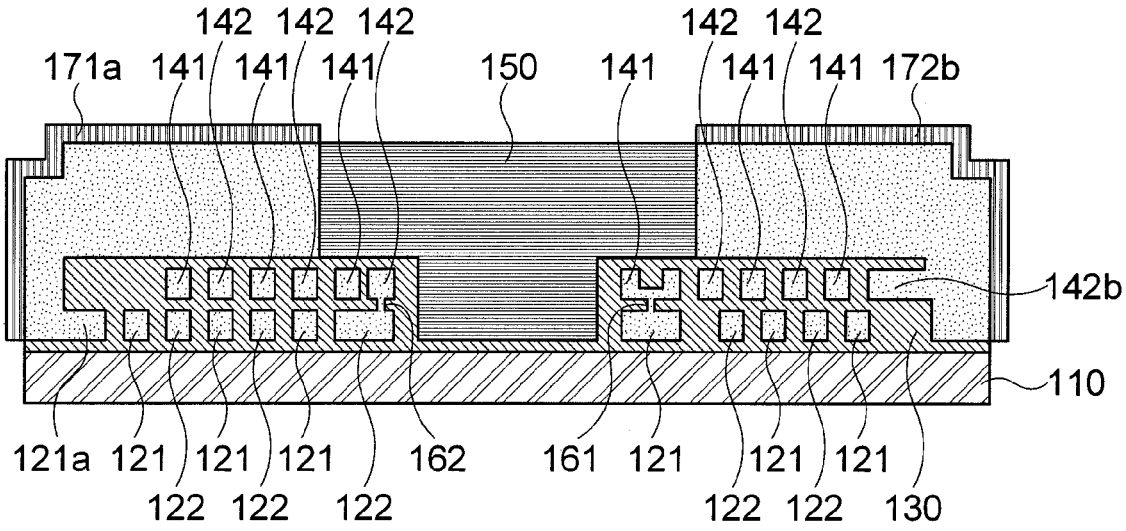
FIG. 3 is a cross-sectional view schematically showing an embodiment of a coil part in accordance with the present invention.
Figure 4A:
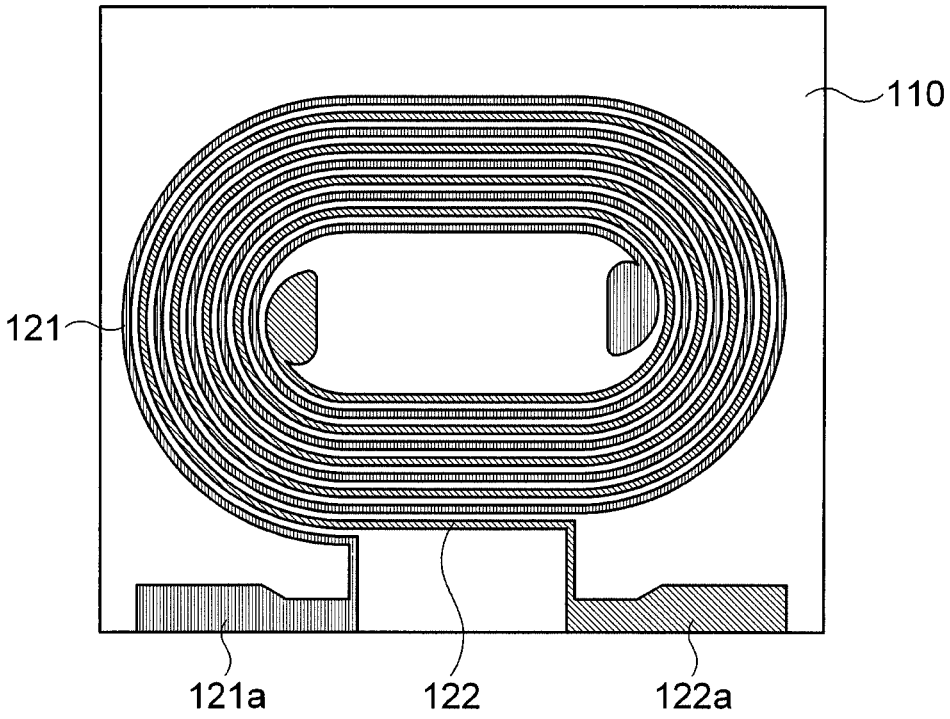
FIG. 4*a* is a plan view schematically showing primary and secondary lower patterns formed on a lower magnetic body of FIG. 3.
Figure 4B:
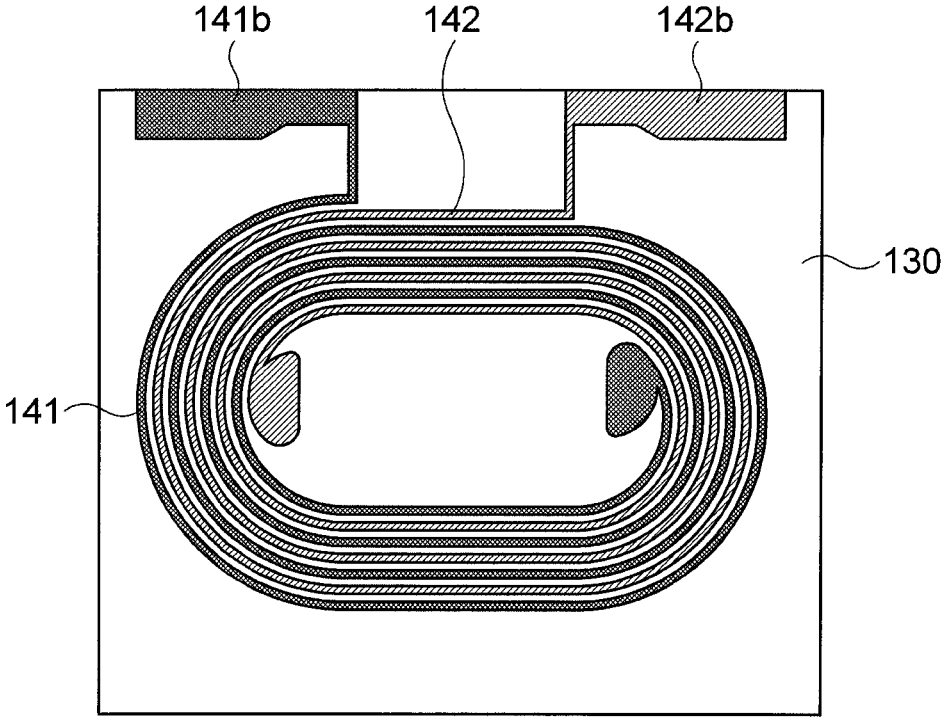
FIG. 4*b* is a plan view schematically showing primary and secondary upper patterns formed on a lower insulating layer of FIG. 3.
Figure 5A:
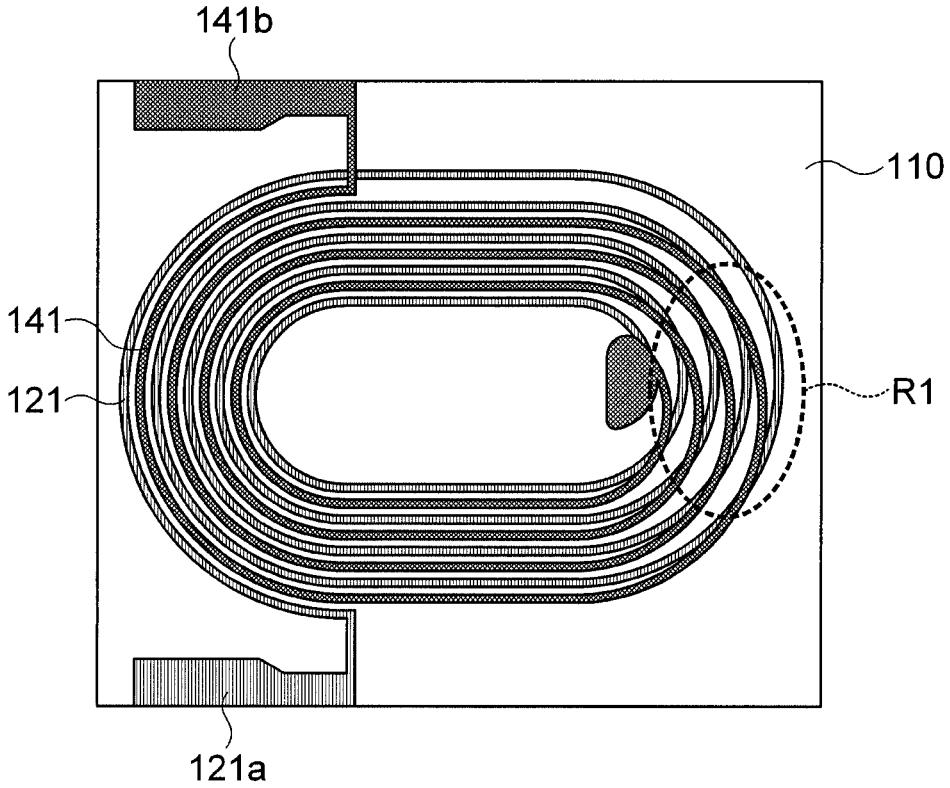
FIG. 5*a* is a plan view schematically showing a state in which the primary lower pattern of FIG. 4*a* and the primary upper pattern of FIG. 4*b* are continuously formed in a spiral shape on the same plane.
Figure 5B:
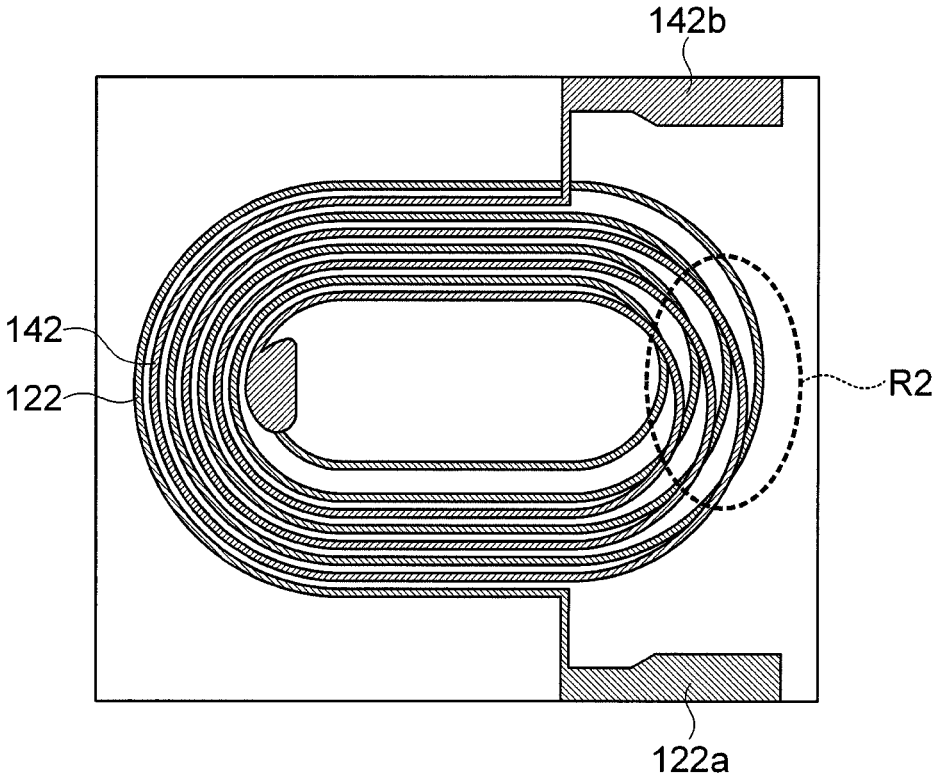
FIG. 5*b* is a plan view schematically showing a state in which the secondary lower pattern of FIG. 4*a* and the secondary upper pattern of FIG. 4*b* are continuously formed in a spiral shape on the same plane.
Figure 6:
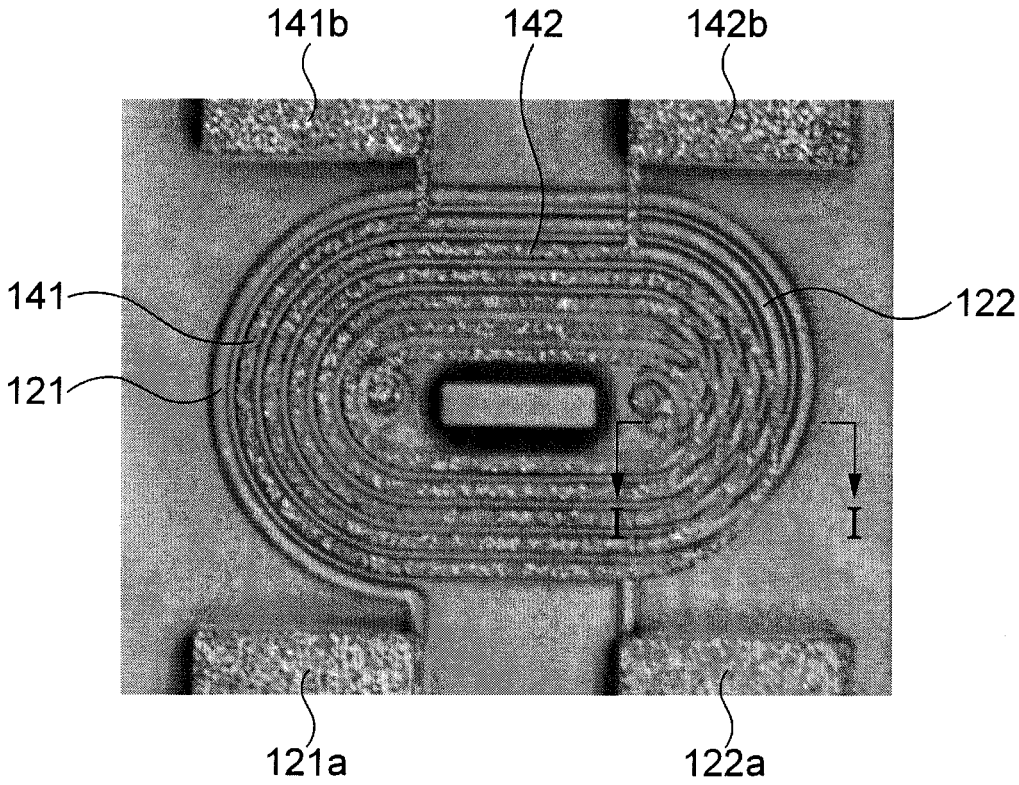
FIG. 6 is a photograph schematically showing a state in which the primary and secondary lower patterns and the primary and secondary upper patterns are continuously formed in a spiral shape in an embodiment of the coil part in accordance with the present invention.
Figure 7:
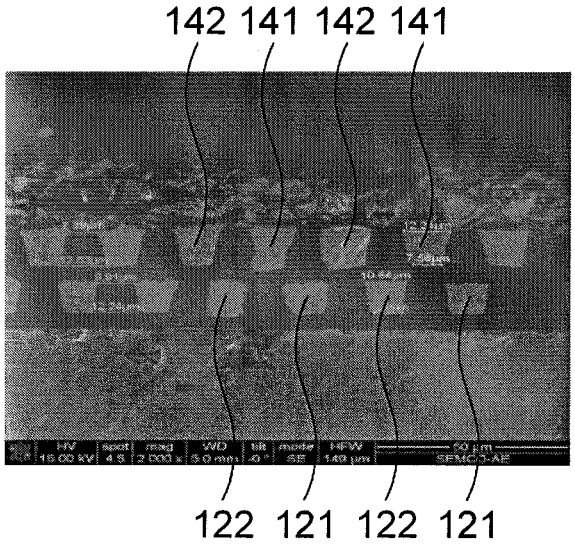
FIG. 7 is a cross-sectional photograph taken along I-I' of FIG. 6.

FIG. 3 is a cross-sectional view schematically showing an embodiment of a coil part in accordance with the present invention, FIG. 4*a* is a plan view schematically showing primary and secondary lower patterns formed on a lower magnetic body of FIG. 3, FIG. 4*b* is a plan view schematically showing primary and secondary upper patterns formed on a lower insulating layer of FIG. 3, FIG. 5*a* is a plan view schematically showing a state in which the primary lower pattern of FIG. 4*a* and the primary upper pattern of FIG. 4*b* are continuously formed in a spiral shape on the same plane, FIG. 5*b* is a plan view schematically showing a state in which the secondary lower pattern of FIG. 4*a* and the secondary upper pattern of FIG. 4*b* are continuously formed in a spiral shape on the same plane, FIG. 6 is a photograph schematically showing a state in which the primary and secondary lower patterns and the primary and secondary upper patterns are continuously formed in a spiral shape in an embodiment of the coil part in accordance with the present invention, and FIG. 7 is a cross-sectional photograph taken along I-I' of FIG. 6.

Figure 8A:
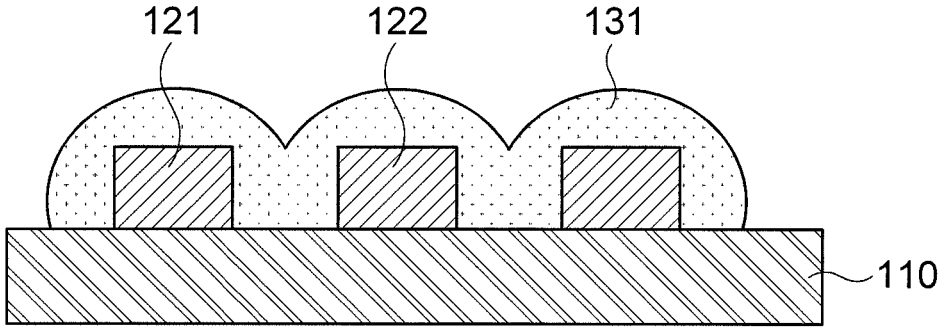
Figure 8B:
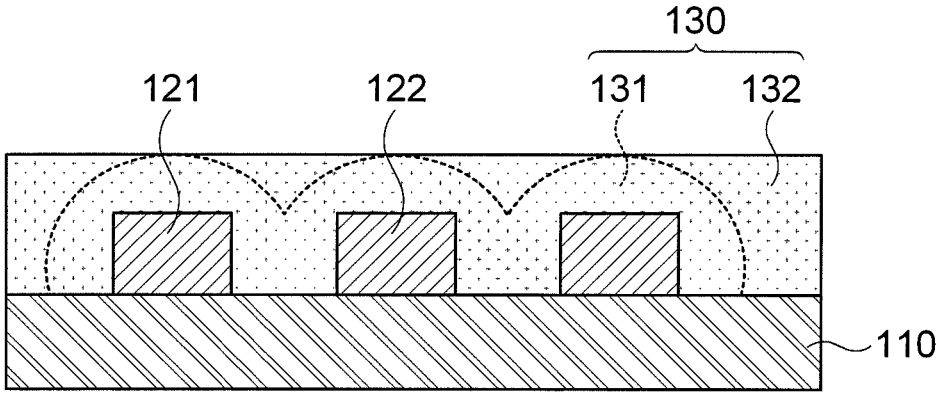
Figure 8C:
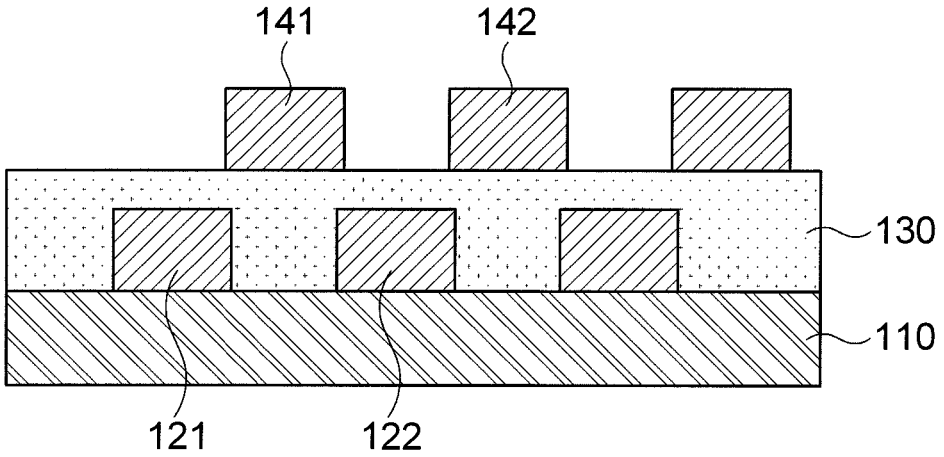

And, FIGS. 8*a* to 8*c* are process diagrams schematically showing a process of forming the primary and secondary lower patterns and the primary and secondary upper patterns, wherein FIG. 8*a* is a view showing a state in which a primary coating layer is formed on the primary and secondary lower patterns, FIG. 8*b* is a view showing a state in which a secondary coating layer is formed on the primary coating layer of FIG. 8*a*, and FIG. 8*c* is a view showing a state in which the primary and secondary upper patterns are formed on the secondary coating layer of FIG. 8*b*.

Figure 9A:
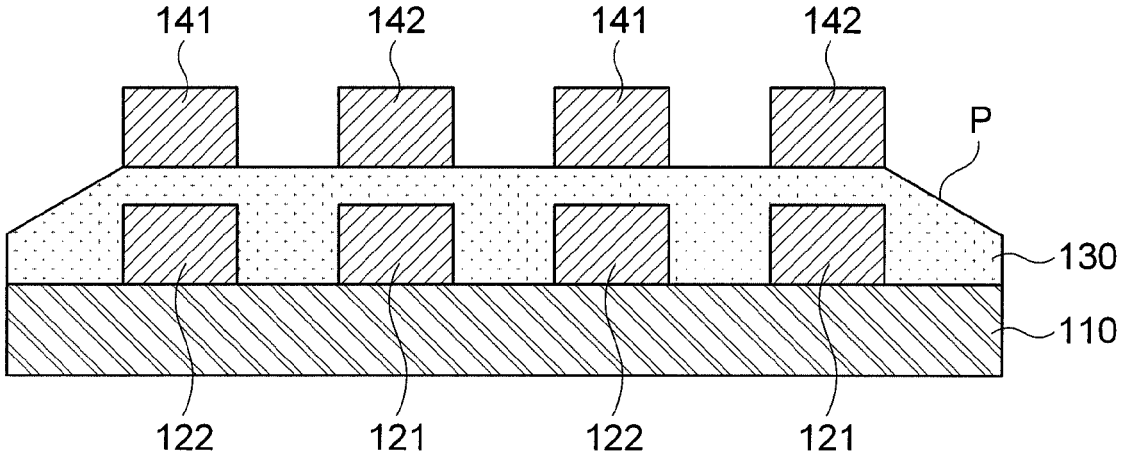
FIG. 9*a* is a cross-sectional view for schematically explaining a phenomenon that a step is generated when the secondary coating layer of FIG. 8*b* is formed.
Figure 9B:
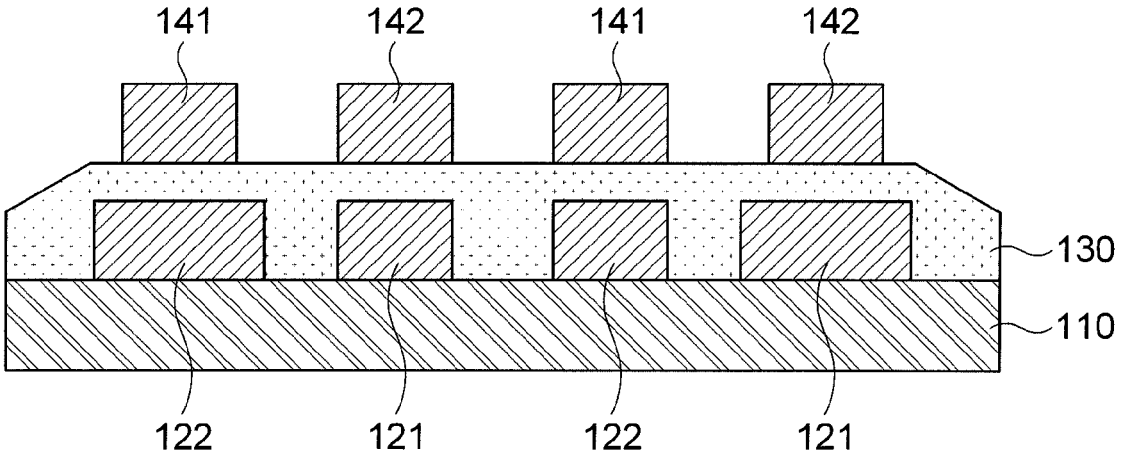
FIG. 9*b* is a cross-sectional view in which the shape of the primary and secondary lower patterns is changed in order to overcome the phenomenon of FIG. 9*a;*
Figure 10:
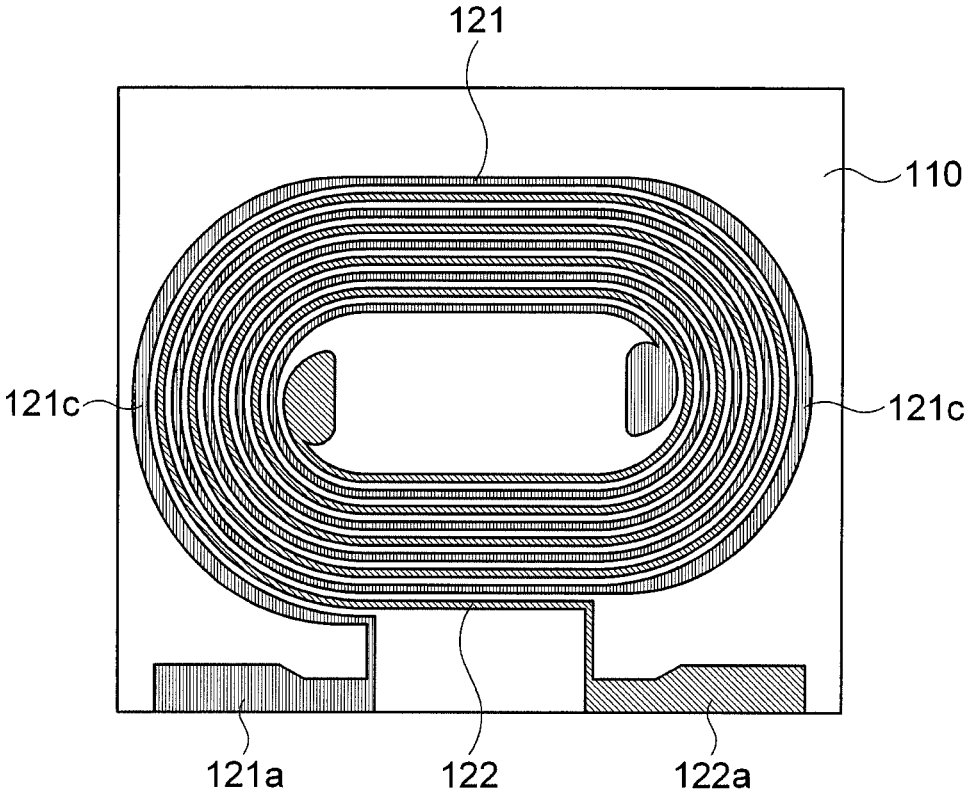
FIG. 10 is a plan view in which the shape of the primary and secondary lower patterns is changed in order to adjust a resistance difference due to a length difference between the primary and secondary lower patterns in an embodiment of the coil part in accordance with the present invention.

Further, FIG. 9*a* is a cross-sectional view for schematically explaining a phenomenon that a step is generated when the secondary coating layer of FIG. 8*b* is formed, FIG. 9*b* is a cross-sectional view in which the shape of the primary and secondary lower patterns is changed in order to overcome the phenomenon of FIG. 9*a*, FIG. 10 is a plan view in which the shape of the primary and secondary lower patterns is changed in order to adjust a resistance difference due to a length difference between the primary and secondary lower patterns in an embodiment of the coil part in accordance with the present invention.

Referring to FIG. 3, an embodiment 100 of a coil part in accordance with the present invention may include a lower magnetic body 110, primary and secondary lower patterns 121 and 122 formed on the lower magnetic body 110, a lower insulating layer 130 covering the primary and secondary lower patterns 121 and 122, primary and secondary upper patterns 141 and 142 formed on the lower insulating layer 130 to be electrically connected to the primary and secondary lower patterns 121 and 122, and an upper magnetic body 150 disposed on the primary and secondary upper patterns 141 and 142.

The lower magnetic body 110 may be formed in the shape of a substrate made of a ferrite magnetic material.

As in FIG. 4*a*, the primary and secondary lower patterns 121 and 122 may be formed on the lower magnetic body 110 through a thin-film process while being disposed in a spiral shape in parallel to each other, and as in FIG. 4*b*, the primary and secondary upper patterns 141 and 142 may be formed on the lower insulating layer 130 through a thin-film process while being disposed in a spiral shape in parallel to each other to correspond to the primary and secondary lower patterns 121 and 122.

Accordingly, the coil part 100 of this embodiment can improve performance by forming a primary pattern and a secondary pattern, that is, two coil patterns on the same layer.

As an example, it is possible to implement characteristics of the coil part by a single coil layer including at least one primary pattern and at least one secondary pattern among the primary and secondary lower patterns 121 and 122 and the primary and secondary upper patterns 141 and 142, and it is possible to increase capacity and have high performance and characteristics by maximizing generation of electromagnetic force of the coil part when the coil part is implemented with multiple layers of coil layers consisting of the primary and secondary lower patterns 121 and 122 and the primary and secondary upper patterns 141 and 142 like a conventional common-mode filter.

Further, in the coil part 100 of this embodiment, by forming the primary pattern and the secondary pattern, that is, the two coil patterns on the same layer, it is possible to simultaneously form input-side lead patterns 121*a* and 122*a* of the primary and secondary lower patterns 121 and 122 on the layer on which the primary and secondary lower patterns 121 and 122 are formed and output-side lead patterns 141*b* and 142*b* of the primary and secondary upper patterns 141 and 142 on the layer on which the primary and secondary upper patterns 141 and 142 are formed. Therefore, since there is no need for an additional layer for forming the output-side lead pattern compared to the conventional common-mode filter, it is possible to reduce the thickness of the insulating layer which covers the primary and secondary lower patterns 121 and 122 and the primary and secondary upper patterns 141 and 142, thus making it possible to implement miniaturization due to a decrease in the vertical height of the coil part including it.

Here, in the coil part of this embodiment, the primary and secondary upper patterns 141 and 142 have portions which cross the primary and secondary lower patterns 121 and 122 on the plane.

That is, as shown in FIG. 5*a*, the primary upper pattern 141 may have a portion R1, which crosses the primary lower pattern 121 on the plane, on the primary lower pattern 121, and as shown in FIG. 5*b*, the secondary upper pattern 142 may have a portion R2, which crosses the secondary lower pattern 122 on the plane, on the secondary lower pattern 122.

Accordingly, referring to FIGS. 5*a* to 7, the primary and secondary upper patterns 141 and 142 can be arranged to be positioned in a space between the primary and secondary lower patterns 121 and 122, that is, between the primary lower pattern 121 and the secondary lower pattern 122 in the crossing portions by the crossing portions R1 and R2.

And, the primary and secondary upper patterns 141 and 142 may be arranged to be positioned on the primary and secondary lower patterns 121 and 122 except the crossing portions.

At this time, the primary and secondary upper patterns 141 and 142 may be arranged to cross arrangement of the primary and secondary lower patterns 121 and 122.

That is, the secondary upper pattern 142 may be arranged to be positioned on the primary lower pattern 121, and the primary upper pattern 141 may be arranged to be positioned on the secondary lower pattern 122.

Meanwhile, referring to FIGS. 8*a* to 8*b*, the lower insulating layer 130 may include a primary coating layer 131 which covers the primary and secondary lower patterns 121 and 122 and a secondary coating layer 132 which planarizes an upper surface of the primary coating layer 131.

That is, when forming the lower insulating layer 130 through once coating, as in FIG. 8*a*, since the lower insulating layer 130 is formed to have an uneven portion on an upper surface thereof and thus has difficulty in forming the primary and secondary upper patterns on the upper surface thereof in accurate position and shape, the secondary coating layer 132 is formed on the primary coating layer 131 having an uneven portion on an upper surface thereof as in FIG. 8*b* to form the lower insulating layer 130 having the planarized upper surface as in FIG. 8*c*. Accordingly, it is possible to accurately pattern and form the primary and secondary upper patterns on the lower insulating layer.

Meanwhile, referring to FIG. 9*a*, although the lower insulating layer 130 is formed through two coating processes, since coating is not often performed (P) in the region where the primary and secondary lower patterns 121 and 122 are not formed, arrangement of the primary and secondary upper patterns 141 and 142 positioned in the above region may be twisted. Accordingly, as shown in FIG. 9*b*, widths of the primary and secondary lower patterns 121 and 122 may be formed larger than those of the primary and secondary upper patterns 141 and 142.

Especially, widths of the innermost pattern and the outermost pattern of the primary and secondary lower patterns 121 and 122 may be formed larger than that of the pattern positioned between the innermost pattern and the outermost pattern.

Meanwhile, referring to FIG. 6, the primary and secondary upper patterns 141 and 142 are formed in a spiral shape extending from the primary and secondary lower patterns 121 and 122 and having the same number of turns. In order to improve matching of the primary and secondary upper patterns 141 and 142 with respect to the primary and secondary lower patterns 121 and 122, an output-side portion of the outermost pattern of the primary and secondary upper patterns 141 and 142 may be formed to be positioned on the pattern adjacent to the inside of the outermost pattern of the primary and secondary lower patterns 121 and 122.

Accordingly, the output-side portion of the outermost pattern of the primary and secondary upper patterns 141 and 142 can be arranged to be positioned inwardly of an output-side portion of the outermost pattern of the primary and secondary lower patterns 121 and 122 as much as a difference of the even number of turns.

It is possible to minimize twist between the patterns through the above structure. Accordingly, it is possible to minimize generation of unnecessary parasitic capacity due to the twist between the patterns.

Meanwhile, referring to FIG. 10, the coil part 100 of this embodiment may further include a resistance tuning portion expanding from a portion of the outermost pattern of the longer pattern of the primary and secondary lower patterns 121 and 122. In this embodiment, the longer pattern may be the primary lower pattern 121. Accordingly, the primary lower pattern 121 may have a resistance tuning portion 121*c* expanding from a portion of the outermost pattern.

As an example, when the number of turns of the primary lower pattern 121 is five, the number of turns of the secondary lower pattern 122 may be about 4.7. Accordingly, a resistance difference may occur according to a length difference between the primary lower pattern 121 and the secondary lower pattern 122.

Therefore, the coil part 100 in accordance with this embodiment can prevent performance degradation due to the resistance difference by adjusting the resistance difference due to the length difference between the primary and secondary lower patterns 121 and 122 through the resistance tuning portion 121*c*.

Meanwhile, referring to FIG. 3, the primary and secondary upper patterns 141 and 142 and the primary and secondary lower patterns 121 and 122 may be electrically connected through vias 161 and 162.

That is, the primary upper pattern 141 and the primary lower pattern 121 may be electrically connected through the via 161, and the secondary upper pattern 142 and the secondary lower pattern 122 may be also electrically connected through the via 162.

And, the upper magnetic body 150 may be formed by filling a ferrite magnetic material on the primary and secondary upper patterns 141 and 142. At this time, a center portion of the upper magnetic body 150 may extend to centers of the primary and secondary lower patterns 121 and 122.

Therefore, it is possible to improve performance and characteristics of the coil part 100 of this embodiment by extending the upper magnetic body 150.

Figure 11:
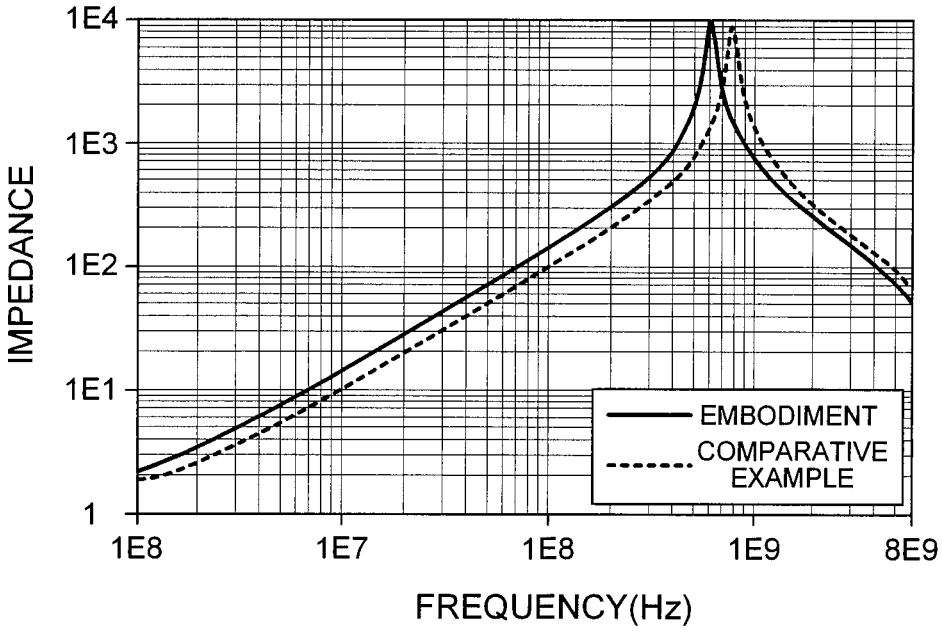
FIG. 11 is a graph showing impedance characteristics in a common mode of an embodiment of the coil part in accordance with the present invention and the common-mode filter as the conventional coil part.

Meanwhile, FIG. 11 is a graph showing impedance characteristics in a common mode of an embodiment of the coil part in accordance with the present invention and a common-mode filter as a conventional coil part. As shown in FIG. 11, it is possible to check that an impedance value (embodiment) in the common mode of the coil part of this embodiment is remarkably increased compared to impedance value (comparative example) in the common mode of the common-mode filter as the conventional coil part in the same frequency.

A process of manufacturing the coil part of this embodiment configured as above will be described below in detail.

Referring to FIGS. 3 to 5*b*, first, a lower magnetic body 130 consisting of a ferrite substrate is prepared.

And, primary and secondary lower patterns 121 and 122 are formed on the lower magnetic body 130 in a spiral shape in parallel to each other.

Next, a lower insulating layer 130 is formed to cover the primary and secondary lower patterns 121 and 122. At this time, it is preferred that the lower insulating layer 130 is formed through two coating processes.

And, primary and secondary upper patterns 141 and 142 are formed on the lower insulating layer 130 in a spiral shape in parallel to each other to correspond to the primary and secondary lower patterns 121 and 122.

Here, the primary and secondary upper patterns 141 and 142 may have portions which cross the primary and secondary lower patterns 121 and 122 on the plane.

And, the primary and secondary upper patterns 141 and 142 may be arranged to cross arrangement of the primary and secondary lower patterns 121 and 122. The primary and secondary upper patterns 141 and 142 may be arranged to be positioned in a space between the primary and secondary lower patterns 121 and 122 in the crossing portions.

After that, an insulating layer, which is made of a material similar to that of the lower insulating layer 130, is formed to cover the primary and secondary upper patterns 141 and 142.

And, an upper magnetic body 150 is formed by filling a magnetic material on the insulating layer.

Next, an external terminal 171*a*, which is connected to input-side lead patterns 121*a* and 122*a* of the primary and secondary lower patterns 121 and 122, is plated, and an external terminal 172*b*, which is connected to output-side lead patterns 141*a* and 142*b* of the primary and secondary upper patterns 141 and 142, is plated.

Since the technical features of the detailed manufacturing process of the coil part 100 of this embodiment are disclosed in the above detailed description of the structure of the coil part 100 of this embodiment, a detailed description thereof will be omitted.

As described above, according to the coil parts and the method of manufacturing the same in accordance with the present invention, it is possible to implement high common-mode impedance in the same frequency.

And, according to the coil parts and the method of manufacturing the same in accordance with the present invention, it is possible to improve performance and capacity.

Further, according to the coil parts and the method of manufacturing the same in accordance with the present invention, it is possible to reduce manufacturing costs and improve productivity through simplification of structure and processes.

The foregoing description illustrates the present invention. Additionally, the foregoing description shows and explains only the preferred embodiments of the present invention, but it is to be understood that the present invention is capable of use in various other combinations, modifications, and environments and is capable of changes and modifications within the scope of the inventive concept as expressed herein, commensurate with the above teachings and/or the skill or knowledge of the related art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. A coil part comprising:

a lower magnetic body;

primary and secondary lower patterns formed on the lower magnetic body in a spiral shape in parallel to each other;

a lower insulating layer covering the primary and secondary lower patterns;

primary and secondary upper patterns electrically connected to the primary and secondary lower patterns, respectively, and formed on the lower insulating layer in a spiral shape in parallel to each other to correspond to the primary and secondary lower patterns; and an upper magnetic body formed on the primary and secondary upper patterns, wherein the primary and secondary upper patterns have portions which cross the primary and secondary lower patterns on the plane, wherein the primary and secondary upper patterns are arranged to cross arrangement of the primary and secondary lower patterns, and wherein the primary upper pattern is arranged to be positioned in a space between the primary lower pattern and the secondary lower pattern, and the secondary upper pattern is arranged to be positioned in a space between the primary lower pattern and the secondary lower pattern in the crossing portions.

2. The coil part according to claim 1 wherein the lower insulating layer comprises a primary coating layer covering the primary and secondary lower patterns and a secondary coating layer for planarizing an upper surface of the primary coating layer.

3. The coil part according to claim 1, wherein widths of the primary and secondary lower patterns are formed larger than those of the primary and secondary upper patterns.

4. The coil part according to claim 3, wherein widths of the innermost pattern and the outermost pattern of the primary and secondary lower patterns are formed larger than that of a pattern positioned between the innermost pattern and the outermost pattern.

5. The coil part according to claim 1, wherein the primary and secondary upper patterns are formed in a spiral shape extending from the primary and secondary lower patterns and having the same number of turns.

6. The coil part according to claim 1, wherein an output-side portion of the outermost pattern of the primary and secondary upper patterns is formed to be positioned on the pattern adjacent to the inside of the outermost pattern of the primary and secondary lower patterns.

7. The coil part according to claim 1, further comprising:

a resistance tuning portion expanding from a portion of the outermost pattern of the longer pattern of the primary and secondary lower patterns.

8. The coil part according to claim 1, wherein the primary and secondary upper patterns and the primary and secondary lower patterns are electrically connected through vias.

9. The coil part according to claim 1, wherein the upper magnetic body is formed to extend to centers of the primary and secondary upper patterns and the primary and secondary lower patterns.

* * * * *